United States Patent [19]

Moriguchi et al.

[11] 4,281,055

[45] Jul. 28, 1981

[54] PHOTOSENSITIVE ELEMENT WITH WATER SOLUBLE INTERLAYER

[75] Inventors: Hiroyuki Moriguchi; Satoshi Haneda; Tadashi Kaneko; Akira Itoh; Takeo Shimura; Masanori Matsumoto; Hiroyuki Nomori, all of Hachioji, Japan

[73] Assignee: Konishiroku Photo Industry Co., Ltd., Tokyo, Japan

[21] Appl. No.: 122,196

[22] Filed: Feb. 19, 1980

[30] Foreign Application Priority Data

Feb. 24, 1979 [JP] Japan ..... 54-20212
Jul. 30, 1979 [JP] Japan ..... 54-96051

[51] Int. Cl.[3] ..... G03G 5/14; G03G 5/087

[52] U.S. Cl. ..... 430/60; 430/87; 430/901; 430/56

[58] Field of Search ..... 430/60, 87, 90, 91

[56] References Cited

U.S. PATENT DOCUMENTS 3,428,452 2/1969 Giaimo ..... 430/91
3,682,629 8/1972 Shimizu et al. ..... 430/60 X
3,885,962 5/1975 MacClaren ..... 430/60

FOREIGN PATENT DOCUMENTS 47-47249 11/1972 Japan ..... 430/60
50-80135 6/1975 Japan ..... 430/60

*Primary Examiner*—Roland E. Martin, Jr.
*Attorney, Agent, or Firm*—Frishauf, Holtz, Goodman & Woodward

[57] ABSTRACT

Photosensitive element for electrophotography which comprises (a) a photosensitive layer composed of (1) a binder resin and (2) particles of photoconductive material being dispersed in said binder resin and each particle comprising a photoconductive zinc oxide particle having been encapsulated over its surface with an encapsulating resinous material;

(b) an electroconductive support for said photosensitive layer; and (c) an intermediate layer being located between said photosensitive layer and said support, and composed of a water-soluble polymer.

The water-soluble polymer preferably is a casein, and a sensitizing agent preferably is adsorbed by the surface of the zinc oxide particle and or included in the encapsulating resinous layer.

6 Claims, 2 Drawing Figures

PHOTOSENSITIVE ELEMENT WITH WATER SOLUBLE INTERLAYER

Figure 1:
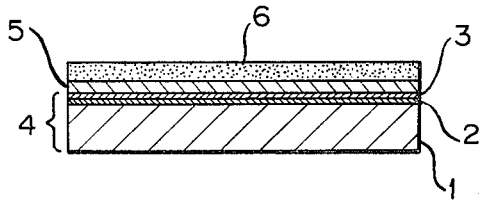

This invention relates to a photosensitive element for electrophotography, and particularly to a photosensitive element having a binder-type photosensitive layer.

The photosensitive element of this type generally consists of an electroconductive support and a photosensitive layer laminated on the support, and this element is used for forming an image in electrophotography through a series of stages comprising a charging stage in which the photosensitive layer is charged, an exposing stage in which an electrostatic latent image is formed by projecting a photoimage on the charged photosensitive layer, a developing stage in which the formed electrostatic latent image is developed with a toner, and so forth.

The binder-type photosensitive layer is composed of particles of photoconductive material dispersed in a binder resin. As the photoconductive material, zinc oxide is particularly mentioned among previously known photoconductive materials. The reasons are that zinc oxide is prepared readily and is inexpensive and that zinc oxide is a light metal oxide giving little harm to human beings and other animals. However, zinc oxide usually has to be subjected to spectral sensitization to extend its spectral sensitivity up to the visible region by means of a sensitizing agent because inherent sensivity of zinc oxide resides in the ultraviolet region. A conventional photosensitive element with a photosensitive layer comprising photoconductive zinc oxide particles, however, has disadvantageous characteristics when employed as a master for the repeated copying process. Moreover, the life of such photosensitive element in terms of practical use is extremely limited.

The above-described disadvantages are further explained below. The photosensitive layer composed of as above gives high memory effect, that is, the photosensitive layer that has been given the increased electroconductivity through irradiation of light requires relatively long time to return back to the state having an increased dark resistance, when the layer is again placed under dark circumstances. Therefore, the photosensitive layer cannot be charged enough for showing the desired potential in the charging stages the electrophotographic processes, particularly, in the trials following the first trial, inclusive, when the layer is employed repeatedly as a master in the electrophotographic process. This results in unsatisfactory maximum image density given in the copied image. Further, the photosensitive layer composed of as above is apt to deteriorate physically and chemically due to various reasons, and the life of the layer practically lapses before the layer provides approximately 1,000 copies, when that photosensitive layer is employed in an electrophotographic process involving transferring the toner image.

Moreover, since the binder-type photosensitive layer forms heterogeneous dispersion composite in a microscopic sense, both of the corona current in the charging stage and the photo-current in the exposing stage are apt to be heterogeneous. For this reason, when the photosensitive layer is formed directly on the electroconductive layer consisting in the surface layer of the electroconductive support, the insulation breakdown extremely tends to take place locally on the photosensitive layer. Further, there possibly is given unsatisfactory adhesion between the electroconductive layer and the photosensitive layer, even though the electroconductive layer consists of a metal layer that, as such, is preferably for that purpose. For coping with such a possible disadvantage, an appropriate intermediate layer may be provided initially on the electroconductive layer, and then the photosensitive layer is placed on the intermediate layer. In that case, the intermediate layer is required to have various extremely severe characteristics and conditions for matching with the natures of the photosensitive layer employed.

In addition to the aforementioned problems, there is another problem, that is as follows. The aforementioned photosensitive element is generally set on the conveyor mechanism consisting of a conveyor belt or a rolling drum within an electrophotographic copying machine. If the conveyor belt is employed for the purpose, the surface of the photosensitive element is likely charged due to the repeated corona discharge and the friction with other elements. This results in a possible difficulty in conveying the photosensitive element, and also gives other difficulties.

For the various reasons heretofore stated, the electrophotographic process involving the aforementioned photosensitive element and a stage for transferring the formed toner image onto a transfer paper will not be able to be repeated beyond 1,000 times even under appropriate conditions, and it will not provided a practically satisfactory copied image beyond these times.

Accordingly, a primary object of this invention is to provide a photosensitive element for electrophotography which comprises on an electroconductive support a binder-type photosensitive layer comprising photoconductive zinc oxide particles dispersed in a binder and an intermediate layer having excellent characteristics matching with the natures of the photosensitive layer and which can show little memory effect even after repeated operation and give good and stable image forming characteristics. The photosensitive element of this invention has such excellent mechanical properties and sufficient durability for practical use that the present element serving as a master can be repeatedly employed providing satisfactory copied image up to sufficiently improved maximum repeatability. Other objects will be apparent from the contents of the specification and claims.

In summary, the present invention provides a photosensitive element for electrophotography which comprises:

(a) a binder-type photosensitive layer composed of
  (1) a binder resin and (2) photoconductive zinc oxide particles being dispersed in said binder resin, said photoconductive zinc oxide particles having been encapsulated over its surface with an encapsulating resinous layer;
(b) an electroconductive support for said photosensitive layer; and
(c) an intermediate layer consisting essentially of a water-soluble polymer and said intermediate layer being located between said photosensitive layer and said support.

The present invention will be described with reference to the attached drawings, which are preferred embodiments of the invention.

Figure 2:
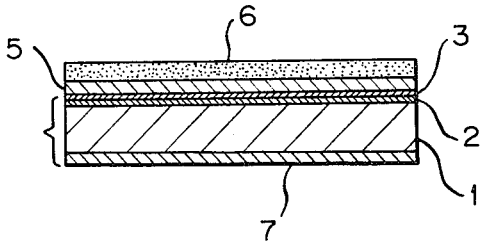

FIG. 1 shows a vertical sectional view of a photosensitive element for electrophotography embodying the present invention and FIG. 2 shows a vertical sectional view of another embodiment.

In FIG. 1, on a surface of a support base 1 is provided an adhesive layer 2 consisting, for example, of a polyethylene or urethane adhesive, and then on the adhesive layer 2 is provided an electroconductive layer 3, for example, made of metallic aluminum foil to form an electroconductive support 4. On the surface of the electroconductive layer 3 of the support 4 is provided an intermediate layer 5 consisting essentially of a water-soluble polymer, and further on the surface of the intermediate layer 5 is formed a photosensitive layer 6 in which photoconductive zinc oxide particles dispersed in a binder and said photoconductive zinc oxide particles having been encapsulated over its surface with an encapsulating resinous material, preferably together with a sensitizing agent for zinc oxide.

As examples of base materials for the electroconductive support there can be mentioned papers, polyethylene films, polypropylene films, polyacrylic films, polyester films, nylon(polyamide) films and other films and these base material can be used either singly or in a combined laminated form. As a preferred example of the material for forming the electroconductive layer, metallic foil, especially, an aluminum foil can be mentioned, however, other metallic foils consisting of copper, zinc or other metal can also be employed. A metal sputtered film may also be employed in place of these metallic foils. Further, the electroconductive layer may be formed by the use of a resinous composite containing electroconductive particles (powder) such as a metallic powder and a carbon black powder dispersed therein. In this case, the aforementioned adhesive layer and/or the support base may be eliminated. However, an appropriately flat surface of the electroconductive layer for giving an image of satisfactory quality may not easily be obtained when the electroconductive particles containing resinous composite is used. Further, the metal sputtered film may have such disadvantages that a mechanically and electrically strong electroconductive layer may not easily be obtained.

As the materials for the intermediate layer to be formed on the electroconductive layer of the electroconductive support, a water-soluble polymer is employed in this invention. The water-soluble polymer in terms of this invention includes those which are soluble either in water or in the mixture of water and an organic solvent such as an alcohol. As such water-soluble polymer, a poly(vinyl alcohol) can be mentioned as a typical example, however, other water-soluble polymers such as poly(vinyl alcohol) derivatives such as poly(vinyl methyl ether) and poly(vinyl ethyl ether); nitrogen-containing vinyl polymers such as poly(vinylamine), poly(N-vinylimidazole), a quaternary salt of poly(vinylpyridine), poly(vinylpyrrolidone) and a vinylpyrrolidone-vinyl acetate copolymer; polyethers such as poly(ethylene glycol) and poly(propylene glycol); poly(acrylic acids) such as poly(acrylic acid) and its salts, poly(acrylamide) and poly(β-hydroxyethyl acrylate); poly(methacrylic acids) such as poly(methacrylic acid) and its salt, poly(methacrylamide), poly(β-hydroxyethyl methacrylate) and poly(hydroxypropyl methacrylate); etherized cellulose polymers such as methyl cellulose, ethyl cellulose, carboxymethyl cellulose, hydroxyethyl cellulose and hydroxypropyl cellulose; poly(ethyleneimine) group polymers such as poly(ethyleneimine); poly(amino acids) such as polyalanine, polyserin, poly(L-glutamic acid), poly(hydroxyethyl-L-glutamine), poly(S-carboxymethyl-L-cysteine), polyproline, a lysine-tyrosine copolymer, a glutamic acid-lysine-alanine copolymer, silk fibroin and casein; and starch and its derivatives such as starch acetate, hydroxyethyl starch, amine starch and phosphate starch. Examples of the polymers which are soluble in a mixture of water and alcohol there can be mentioned a soluble nylon(polyamine) and methoxymethyl nylon(8-nylon).

According to one of the most preferably embodiments of the present invention, a casein is, and the most preferably a casein having been treated with ammonia is employed as a material for the intermediate layer.

Various kinds of caseins can be used in the present invention, however, animal casein, especially Argentine casein is preferable.

The aforementioned intermediate layer can be formed by dissolving the above-mentioned water-soluble polymer in water or in a mixture of water and one or more organic solvents to prepare a solution to be coated and thereafter coating and drying the resulting solution on the electroconductive layer. The coating solution may be admixed with an organic solvent such as methanol or ethanol or with other resin-containing solutions, even if no organic solvent is required for dissolving the water-soluble polymer, so far as the addition of such organic solvent does not give detrimental effect to the solution and when such addition is considered to improve the coating applicability, the drying property and/or the physical properties of the intermediate layer to be formed. The thickness of the intermediate layer may preferably range from 0.1 to 6 microns, and the most preferred range is from 2 to 4 microns.

When casein is employed as the water-soluble polymer for the intermediate layer, it can be prepared by series of steps comprising; putting the casein in water to swell, adding 3–15 ml. of concentrated aqueous ammonia to or blowing gaseous ammonia into 100 g of the casein containing solution, heating the resulting mixture to 60°–80° C. to dissolve it completely to give a coating solution and coating and drying the coating solution on the electroconductive layer. The coating solution can be admixed as hereinbefore described with an organic solvent or with other resin-containing solution for the purpose of improving, coating applicability, drying property or the physical properties of the intermediate layer to be formed. When a casein is employed as the water-soluble polymer, the thickness of the intermediate layer preferably ranges from 1 to 6 microns, and the most preferred range is from 2 to 4 microns. It is particularly preferable when the resulting layer consists of ammonia treated casein and is coated on the electroconduction layer in an amount of from 1 to 6 g/m$^2$, particularly from 2 to 4 g/m$^2$.

The photoconductive zinc oxide particles in the photosensitive layer of the present invention are encapsulated over its surface with an encapsulating resinous layer. In this case a sensitizing agent for the zinc oxide is preferably employed in the photosensitive layer. The sensitizing agent is most preferably present on the surface of the zinc oxide particles encapsulated by the encapsulating resinous layer. These encapsulated photoconductive zinc oxide particles can be prepared as follows: a solution of a sensitizing agent is prepared; to this is added the photoconductive zinc oxide particles (powder); the resulting mixture is stirred, filtered and dried or is stirred and evaporated to dryness by removing the solvent to prepare sensitized zinc oxide particles wherein said sensitizing agent is adsorbed on the surface of said zinc oxide particles; and then the sensitized zinc oxide particles thus obtained are encapsulated with a resinous layer. The procedure for encapsulating these particles are not limited, but the coacervation method or the in-situ polymerization method is preferably applied.

The coacervation method generally comprises the following steps: adding the sensitized zinc oxide particles obtained as above to a solution of an encapsulating resinous material; adding a solvent being freely miscible with the solvent of said solution and incapable of dissolving that encapsulating resinous material, that is named "non-solvent", to that mixture, or evaporating the solvent of the solution, whereby reducing the solubility of the resinous material in the solvent or in the mixed solvent to make the resinous material deposit on the surfaces of the aforementioned sensitized zinc oxide particles.

The in-situ polymerization method generally comprises the following steps; adding the sensitized zinc oxide particles to a solution of a monomer or a prepolymer that can be polymerized to give the encapsulating resinous material; and making the resinous material, as the polymerization proceeds, deposit on the surfaces of the sensitized zinc oxide particles. In carrying out the present in-situ polymerization method, an appropriate procedure for accelerating the formation of the polymer starting from the above-mentioned monomer or prepolymer and the deposition of the polymer on the particle surfaces, such as, the above-stated coacervation method, the heating procedure, the stirring procedure, and so forth, can be employed in combination with the in-situ polymerization method. If a catalyst for the polymerization is required, an appropriate catalyst can be included in the solution.

According to one preferred embodiment of the present invention, the encapsulated photoconductive material thus obtained, contains a photoconductive zinc oxide particle on the surface of which a sensitizing agent is adsorbed previously and therefore the sensitizing agent is generally present between the inner surface of the encapsulating layer and the surface of the zinc oxide particle. However, if the adsorbed sensitizing agent is partly soluble in a solution for the encapsulating resinous layer, then the sensitizing agent may be, in part, incooperated within the encapsulating resinous layer.

Instead of the sensitizing dye being previously made adsorbed on the surface of the photoconductive zinc oxide particles, the sensitizing agent may also be deposited on the surface of the zinc oxide particle simultaneously with the formation of the encapsulating layer when said sensitizing agent is dissolved in the solution of the resin for encapsulating layer formation. In that case, the sensitizing agent may be enclosed in the formed resinous layer, as well as deposited on the surface of zinc oxide particle. In this case, the sensitizing agent may be predominantly deposited on the surface of zinc oxide particle, because adsorption of the sensitizing agent on the surface of zinc oxide particles may occur in advance of the formation of the resinous layer.

There is no specific limitation on the resinous material used for the formation of the encapsulating layer. Preferred examples of such resinous material includes silicone resins, urethane resins, silicone-modified urethane resins, epoxy resins, silicone-modified epoxy resins, and so forth. The encapsulating resinous layer formed by the use of such resins preferably has three-dimensional network structure. This structure can be formed by cross-linking and hardening the resinous layer deposited on the surface simultaneously with or after the formation of the layer. The cross-linking and hardening procedure can performed by the use of a cross-linking agent or as the case may be by simply heating the resinous layer. The thickness of the encapsulating resinous layer may range from 5 angstroms to 1 micron, but preferably it ranges from 10 to 1,000 angstroms, and most preferably from 20 to 100 angstroms. In the present invention as the sensitizing agent for zinc oxide optional one can be employed singly or in combination with one or more of such sensitizing agents. Such sensitizing agent includes xanthine dyes such as Fluorescein, Erythrosine, Phloxine, Rose Bengal, Rhodamine Blue and so forth; triphenylmethane dyes such as Bromocresol Green, Crystal Violet, Malachite Green and so forth; acridine dyes such as Acridine Orange and so forth; cyanine dyes such as merocyanine and so forth; indoaniline dyes; anthraquinone dyes such as Anthraquinone Violet; indigo dyes; azo dyes; and other dyes. Of these dyes, the xanthine dyes or triphenylmethane dyes having acid or lactone structures in the structure are preferred, because of their high solubility and strong absorbability on the surface of the zinc oxide particle. The photosensitive element of the invention is prepared by dispersing the encapsulated photoconductive particles by kneading said particles with binder resin and its solvent, coating and drying the coating solution thus obtained on a electroconductive support directly or, if necessary through any suitable intermediate layer made of a water-soluble polymer and, if necessary, by effecting a conventional heat-treatment after the drying.

The coating solution may contain a certain material such as silicone oil or fluorocarbon for the purpose of improving the spreadability of the coating solution and thus facilitating the coating procedure. Moreover, the material thus contained may improve the undesired toner-filming property.

There is no specific limitation on the binder resin to be employed in the invention. Examples of the binder resin include acrylic resins, silicone resins, melamine resins, urea resins, polyester resins, alkyd resins, polyurethane resins, epoxy resins, phenol resins, furan resins, xylene resins, petroleum resins, a variety of cellulose derivatives, complex resins consisting of these resins, and others. Preferred are complex resins consisting of a thermosetting acrylic resin and melamine resin, these complex resins further comprising an epoxy resin, and complex resins consisting of a silicone resin and an acrylic resin which may further comprise an ethyl cellulose resin.

When a mixture of silicone resin and acrylic resin is used as the binder resin, there is no specific limitation on the ratio between the amount of the silicone resin and that of the acrylic resin, but the silicone resin is preferably included in a ratio of 20 to 70% by weight per the total amount of binder resin, and the acrylic resin is preferably included in a ratio of 10 to 70% by weight per the total amount of binder resin. When an ethyl cellulose resin is further included, it preferably is in a ratio of not more than 50% by weight per the total amount of binder resin. The binder resin thus combined is employed in an amount of 5 to 45 parts by weight, preferably 15 to 35 parts by weight, and most preferably 20 to 30 parts by weight, per 100 parts weight of the encapsulated photoconductive zinc oxide particles.

As described above, a photosensitive element for electrophotography is formed by providing a binder-type photosensitive layer containing the encapsulated photoconductive zinc oxide particles (by which a sensitizing agent is adsorbed) dispersed in the binder resin on an electroconductive support with an intermediate layer consisting essentially of a water-soluble polymer, which is present between the photosensitive layer and the electroconductive support. The photosensitive element according to the present invention, as will be obvious from the examples shown hereinafter in this specification, has such advantageous effects as follows: the memory effect of the photosensitive layer is prominently reduced and the recovery dark resistance is improved, whereby a continuous high speed copying procedure will be possible; and an appropriately high and stable potential can be realized, whereby a copied image with a suitable image contrast can always be obtained.

The photosensitive layer of this invention has excellent resistance against oxidation, humid, light and heat because of the effect given by the encapsulating resinous layer. Moreover, a photosensitive element utilizing the present photosensitive layer can be used even under weaker oxidative atmosphere. Accordingly, the photosensitive layer will have the life longer than that of the conventionally employed elements. Moreover, the photosensitive layer shows extremely high contrast, because a sensitizing agent is kept directly on the surface of zinc oxide particles.

The effects stated in the above are hypothetically considered to originate from the following reasons. It is generally thought that the photoconductivity of the zinc oxide is given by the fact that active spieces consisting of active oxygen atoms such as $O_3$, $O_3^-$, and $O_2^-$ are adsorbed by the zinc oxide particle in the dark to impart to that particle high resistance, and that the active species adsorbed are, in turn, made free from the particle under irradiation of light to impart to the particle the photoconductivity. In an electrophotographic copying machine, these active species are born due to electric discharge from a charge device or others. The photosensitive element of this invention, however, shows the photoconductivity, although the zinc oxide particles are encapsulated with the resinous layer. The reason is thought that the sensitizing agent which is placed on the particle works like the above-mentioned active species or that certain active species included in the resinous layer give the same effect to the zinc oxide. In any case, the active species being present outside do not participate in the photoconductivity of the encapsulated zinc oxide. These assumptions can be justified by the fact that the photosensitive element of this invention can work completely even in an electrophotographic copying machine from which the aforementioned active species are removed.

As described above, a sensitizing agent encapsulated with or included in the resinous layer or certain active species included in the layer can contribute to quick recovery of the dark resistance of the zinc oxide particle, and therefore the memory effect is extremely reduced. Also, the sensitizing agent is protected by the encapsulating resinous layer from various factors which are likely to destroy the agent or which are detrimental to the encapsulated materials. Further, that protection is more complete if the present photosensitive element is employed under conditions free from the aforementioned active species present outside. Under these conditions, the binder resin is necessarily prevented from deteriorating. Thus, the photosensitive element of this invention has a prominently long life.

Moreover, since the photosensitive element of this invention employs an intermediate layer comprising a water-soluble polymer provided between the photosensitive layer and the electroconductive support, the following effects can be also obtained. The hydrophilic intermediate layer adheres either to the electroconductive layer when this layer is made of a metal that is a preferred material, or to the aforementioned photosensitive layer. Therefore, the photosensitive layer, and the electroconductive support together form a strongly fixed unit, and thus a photosensitive element having sufficient mechanical strength can be prepared.

The water-soluble polymer that is employed in this invention generally has the insulating property and imparts to a positive-charged carrier low mobility. For this reason, when the surface of the photosensitive layer is given a negative charge through the negative-charged characteristic of the zinc oxide, the chargeable efficiency of the photosensitive layer is improved because the invasion of a positive-charged carrier from the electroconductive layer to the photosensitive layer is inhibited by the intermediate layer. Further, since the water-soluble polymer imparts a sufficiently high mobility to a negative-charged carrier, the invasion of the negative carrier upon the electroconductive layer is never inhibited when the polymer is exposed to light. Thus, the photoconductive characteristic of the photosensitive layer is brought into full effect.

Moreover, since the so formed intermediate layer is insoluble in most of organic solvents that are employed for preparing a conventional solution for the photosensitive layer formation, the intermediate layer is extremely stable during the period of formation of the photosensitive layer. Accordingly, the intermediate layer can be so prepared as to have homogeneous and strong properties even with a thin layer, and the insulating property of the intermediate layer, therefore, can be adjusted to an appropriate degree of homogeneity over every area of the layer. The resulting homogeneous layer will inhibit the electric breakdown which often occurs on a heterogeneous area of the photosensitive layer and, accordingly, keeps the copied image from getting the so-called white dot. Also the deterioration of the photosensitive layer caused by the electric current is effectively suppressed. Further, the elevation of the residual potential likely caused in an intermediate layer having excessive thickness, this excessive thickness being necessarily given when an intermediate layer with no defect is intended to prepare, can be effectively avoided in the photosensitive element of this invention.

The photosensitive layer is preferred to be formed by coating and drying a coating solution for the photosensitive layer formation which contains a binder resin, as described hereinbefore. However, the selection of a solvent for the coating solution, the selection of a coating procedure, and the selection of the conditions employed for the coating are not limited substantially, because the intermediate layer of this invention is made of a water-soluble polymer and thus that layer is stable in an organic solvent that is preferred and generally employed as a solvent for dissolving a generally hydrophobic binder resin. This means that almost all of the conditions relating to the coating can be utilized giving satisfactory results. One of the other advantageous effects is that the intermediate layer of this invention can hold the water content equivalent to the humidity in a circumstance generally encountered, keeping the electric resistance from becoming elevated, due to the hydrophilic property of the intermediate layer.

In summary, the intermediate layer of this invention shows excellent properties per se and also in conjunction with the photosensitive layer and brings about prolongation of the workable like of the photosensitive element and improvement on the image formation characteristics. Particularly, the intermediate layer of this invention is advantageously employed together with a photosensitive layer that is apt to cause elevation of the residual potential due to the provision of an encapsulating resinous layer onto the surface of zinc oxide particle, because the present intermediate layer can suppress the residual potential produced under exposure to light, as seen from the description hereinbefore.

The photosensitive element for electrophotography of this invention further comprises a resinous backing layer 7 consisting mainly of polyethylene provided onto the reverse side surface of the support base 1 in the electroconductive support 4 serving as a backing support, as shown in FIG. 2.

The structure thus formed keeps the back-side surface of the photosensitive element from getting charged even when the element repeatedly works in an electrophotographic copying machine. Accordingly, the conveyance of the photosensitive element is not disturbed and the copying procedure can be continuously repeated a large number of times. The resinous backing layer is not necessarily provided to the photosensitive element of this invention. However, the provision of the resinous backing layer is advantageous, for an electroconductive support with such a resinous backing layer is available on market with very low price and the effect brought about by the provision is very prominent as described above.

The resinous backing layer is preferred to contain polyethylene in an amount of at least 60% of the total amount of the resin. Thus, there can be employed, as the resinous material, homopolymers of ethylene, copolymers of ethylene and other monomers and a mixture of these polymers and other polymers.

The thickness of the resinous backing layer generally is not more than 70 microns. The provision of the resinous backing layer can be done, for example, by forcing a resinous film adhere to the back-side surface of the support base by the use of a certain adhesive, or by heating a resinous film to fuse with the surface. The charging of the back-side surface of the photosensitive element can be more effectively avoided by mixing and dispersing such a material as carbon black or powdery metal in the resinous backing layer.

The present invention, as described in detail hereinbefore, provides a photosensitive element for electrophotography which has so high mechanical strength that an electrophotographic copying procedure can be continuously and satisfactorily repeated a large number of times and which imparts the excellent and stable image formation characteristics, such as the reduced deterioration and the extremely lowered memory effect, to the photosensitive layer or the other portions, by means of the encapsulation of the photoconductive material, the provision of the selected intermediate layer and, optionally, the provision of the selected resinous backing layer, although the present photosensitive element utilizes a conventional binder-type photosensitive layer comprising zinc oxide particles as photoconductive material. Consequently, the present invention provides a photosensitive element for electrophotography which can be used for producing a great number of fine image copies.

The present invention will be further illustrated by the following examples, but these examples are not intended to restrict the present invention.

EXAMPLE 1

To 2 l. of water was, little by little, added 100 g. of a poly(vinyl alcohol) "Denka Poval K-17E" (available from Denki Kagaku Kogyo K.K., Japan) under stirring. After the addition was complete, the mixture was heated to 80° C. for one hour under stirring to dissolve the added poly(vinyl alcohol) completely. The resulting aqueous solution was allowed to be cooled to room temperature, and filtered over a 200 mesh filter to obtain a coating solution for the intermediate layer formation.

On an electroconductive layer of an electroconductive support which is composed of a poly(ethylene telephthalate) film, as a base support, with an aluminum foil, as an electroconductive layer, overlaid on the film, was coated the coating solution for the intermediate layer formation as prepared above to give a coated amount of 2–3 g./m$^2$ (film thickness: 2–3 microns) after being dried, means of a roller coating device. The coated solution was dried to form an intermediate layer.

Separately, in 100 ml. of methyl ethyl ketone was dissolved 0.5 g. of a free acid form of Rose Bengal that had been prepared by acid decomposition of Rose Bengal disodium salt. To the resulting solution was added 100 g. of a photoconductive zinc oxide powder "SAZEX 4000" (available from Sakai Chemical Industry Co., Ltd., Japan), and the mixture was then treated in a ball mill for one hour to make a dispersion. Upon evaporation of the methyl ethyl ketone, there was obtained a sensitized zinc oxide powder absorbing Rose Bengal on its surface.

In a mixture of 170 ml. of methyl ethyl ketone that would dissolve the silicone epoxy varnish to be added lately and 30 ml. of isoparaffin having little dissolving characteristic (non-solvent) "Isopar-H" (available from Esso Petrochemical Co., Ltd., Japan) was dispersed 100 g. of the sensitized zinc oxide powder. To the resulting dispersion were added 2.2 g. of a silicone epoxy varnish "ES 1001N" (available from Shin-Etsu Chemical Co., Ltd., Japan) and 0.3 g. of a curing agent therefor "D-15" (available from Shin-Etsu Chemical Co., Ltd.), and the resulting mixture was then dispersed by applying ultrasonic thereto for one hour. The dispersion was then evaporated slowly in a rotary evaporator to remove the methyl ethyl ketone, thereby forming the silicone epoxy varnish deposit onto the sensitized zinc oxide powder obtained before. To the resulting mixture was added 170 ml. of the above-identified non-solvent "Isopar-H" and the mixture was then heated at 150° C. for 3 hours. The solid particles were collected by filtration over a glass filter and dried to prepare a photoconductive material having an encapsulating layer made of a silicone-modified epoxy resin.

| | |
|---|---|
| Encapsulated photoconductive material prepared as above | 100 g. |
| 50% Solution of acrylic resin "Dianal HR-112" (available from Mitsubishi Rayon Co., Ltd., Japan) | 40 g. |
| 50% Solution of butyrated melamine resin "Super-Beckamine J-820" (available from Dainippon Ink and Chemicals, Inc., Japan) | 8 g. |
| Silicone oil "KF 96" (available from Shin-Etsu Chemical Co., Ltd.) | 0.5 g. |

-continued

| | |
|---|---|
| Toluene | 100 ml. |

The mixture of the above formulation was dispersed for one hour by means of a ball mill to prepare a coating solution for the photosensitive layer formation.

The coating solution thus obtained was coated on the aforementioned intermediate layer laid on the electroconductive support to prepare a film of the thickness of 30 g./m$^2$ (after being dried), and dried by applying the blowing air kept at 70° C. thereto. The resulting element was further heated for one hour in an oven kept at 100° C. to prepare an electrophotographic photosensitive element.

The photosensitive element thus obtained was subjected to a continuous copying test by loading the element on a conveyor belt for a photosensitive element in an electrophotographic copying machine "U-Bix 1500" (available from Konishiroku Photo Ind. Co., Ltd., Japan). A high gradation reproducibility giving a high contrast copied image was produced even after the copying procedure was continuously repeated 10,000 times.

Comparison between the first copied image and the second copied image shows no distinguishable difference on the image contrast, and thus there was confirmed substantially no memory effect appearing in this sytem.

An electrophotographic photosensitive element was prepared, for comparison, by employing the same procedures as stated above, except for replacing the encapsulated zinc oxide particles with simple zinc oxide particles with no coating layer. The copying test carried out above was repeated using the electrophotographic photosensitive element thus prepared. When the number of repeated copying procedures reached around 1,000 times, an obtained copied image began to show reduced image contrast and the fog began to be seen on the image to render the image obscure. Comparison between the first and second copied images showed that the second image was worse than the first image. Also, the memory effect was found to appear.

Another electrophotographic photosensitive element was prepared, also for comparison, by employing the same procedures as stated above, except for providing no intermediate layer so that the photosensitive layer was formed directly on the electroconductive layer. The copying test as above was repeated using the element thus prepared. When the number of the repeated copying procedures reached beyond 500 times, a fog began to be seen on the copied image, and a white dot due to insulation break-down of the photosensitive layer was also noted to appear.

EXAMPLE 2

To a mixture of 1.6 l. of methanol and 0.4 l. of water was, little by little, added 100 g. of a soluble-type nylon "Type 6021" (available from Ube Industries, Ltd., Japan) under stirring, and the resulting mixture was heated to 60° C. for 30 minutes to make a solution. Thus, a coating solution for the intermediate layer formation was prepared. This coating solution was then laid onto an electroconductive support to form an intermediate layer in the same manner as in Example 1.

Separately, 100 g. of a photoconductive zinc oxide powder "SAZEX 4000" was added to a mixture of 150 ml. of ethyl acetate dissolving 0.5 g. of a free acid form of Rose Bengal therein and 50 ml. of a non-solvent "Isopar-H", and the resulting mixture was further treated in a ball mill for one hour to make a dispersion. To the dispersion were added 1.0 g. of a silicone polyol "KR 302A" (available from Shin-Etsu Chemical Co., Ltd.) and 0.5 g. of a poly(isocyanate) "KR 302B" (available from Shin-Etsu Chemical Co., Ltd.), and the mixture was again treated in a ball mill for one hour. The ethyl acetate was evaporated in a rotary evaporator, and 150 ml. of a non-solvent "Isopar-H" was added to the residue. The mixture was heated to 130° C. for one hour, and the solid particles were collected by filtration and dried. Thus, a photoconductive material encapsulated with the silicone-modified urethane resin was prepared.

| | |
|---|---|
| Encapsulated photoconductive material prepared as above | 100 g. |
| 70% Solution of silicone resin "KR 214" (available from Shin-Etsu Chemical Co., Ltd.) | 15 g. |
| 50% Solution of acrylic resin "ST-10" (available from Soken Chemical Co., Ltd., Japan) | 20 g. |
| 7.5% Solution of ethyl cellulose "STD-45" (available from Dow Chemical Co., Ltd., U.S.A.) | 60 g. |
| Toluene | 100 ml. |

The mixture of the above formulation was dispersed for one hour by means of a ball mill to prepare a coating solution for the photosensitive layer formation. The coating solution thus obtained was coated on the intermediate layer on the aforementioned electroconductive support to form a photosensitive layer in the same manner as in Example 1. Thus, there was prepared an electrophotographic photosensitive element.

The photosensitive element was subjected to a continuous copying test by providing it to an electrophotographic copying machine "U-Bix 1500" (available from Koshishiroku Photo Ind. Co., Ltd.). A high gradation reproducibility giving a high contrast copied image was produced even after the copying procedure was continuously repeated 10,000 times. Also, there was confirmed substantially no memory effect appearing in this system.

EXAMPLE 3

To 100 g. of Argentine casein (available from Kanto Chemical Co., Ltd., Japan) was added 400 ml. of water, and this mixture was heated to 40° C. for 4 hours to make the casein swell. To this was further added 10 ml. of concentrated aqueous ammonia, and the mixture was stirred. Then, a mixture of water and methanol (8:2) was added to the resulting mixture to make the total volume to one liter. The coating solution for the intermediate layer formation thus obtained was coated on the electroconductive support in the same manner as in Example 1 to prepare an intermediate layer.

| | |
|---|---|
| Encapsulated photoconductive material identical to one in Example 1 | 100 g. |
| 70% Solution of silicone resin "KR 213" (available from Shin-Etsu Chemical Co., Ltd.) | 15 g. |
| 50% Solution of acrylic resin "ST-10" (available from Soken Chemical Co., Ltd.) | 20 g. |
| 7.5% Solution of ethyl cellulose "STD-45" (available from Dow | |

-continued

| | |
|---|---|
| Chemical Co., Ltd.) | 60 g. |
| Toluene | 100 ml. |

The mixture of the above formulation was dispersed for one hour by means of a ball mill to prepare a coating solution for the photosensitive layer formation. The coating solution thus obtained was coated on the intermediate layer on the aforementioned electroconductive support to form a photosensitive layer in the same manner as in Example 1. Thus, there was prepared an electrophotographic photosensitive element.

The photosensitive element was then subjected to a continuous copying test by loading the element on a conveyor belt for a photosensitive element in an electrophotographic copying machine "U-Bix 1500" (available from Konishiroku Photo Ind. Co., Ltd.). A high gradation reproducibility giving a high contrast copied image was still produced even after the copying procedure was continuously repeated 10,000 times.

Comparison between the first copied image and the second copied image showed no distinguishable difference on the image contrast, and thus there was confirmed substantially no memory effect appearing in this sytem.

EXAMPLE 4

To 100 g. of Argentine casein (available from Kanto Chemical Co., Ltd.) was added 400 ml. of water, and this mixture was allowed to stand overnight at room temperature to make the casein swell. To this was further added 6 ml. of concentrated aqueous ammonia (38% conc., available from Kanto Chemical Co., Ltd.), and the mixture was stirred. Then, water was added to the resulting mixture to make the total volume to one liter. The aqueous mixture was heated to 70° C. for 30 minutes under stirring to give a complete solution. The resulting solution was subsequently cooled to room temperature and filtered over a 200 mesh filter to prepare a coating solution for the intermediate layer.

On an electroconductive layer of an electroconductive support which is composed of a paper, as a base support, with an aluminum foil, as an electroconductive layer, overlaid on one surface of the paper, and with a poly (ethylene telephthalate) film, as a resinous layer, overlaid on another surface of the paper, was coated the coating solution for the intermediate layer formation as prepared above to give a coated amount of 2–3 g./m$^2$ (film thickness: 2–3 microns) after being dried, by means of roller coating device. The coated solution was dried to form an intermediate layer.

Separately, in 100 ml. of methyl ethyl ketone was dissolved 0.5 g. of a free acid form of Rose Bengal that had been prepared by acid decomposition of Rose Bengal.disodium salt. To the resulting solution was added 100 g. of a photoconductive zinc oxide powder "SAZEX 4000" (available from Sakai Chemical Industry Co., Ltd.), and the mixture was then treated in a ball mill for one hour to make a dispersion. Upon evaporation of the methyl ethyl ketone, there was obtained a sensitized zinc oxide powder adsorbing Rose Bengal on its surface.

In a mixture of 170 ml. of methyl ethyl ketone that would dissolve the silicone epoxy varnish to be added lately and 30 ml. of isparaffin non-solvent "Isopar-H" (available from Esso Petrochemical Co., Ltd.) was dispersed 100 g. of the sensitized zinc oxide powder. To the resulting dispersion were added 2.2 g. of a silicone epoxy varnish "ES 1001N" (available from Shin-Etsu Chemical Co., Ltd.) and 0.3 g. of a curing agent therefor "D-15" (available from Shin-Etsu Chemical Co., Ltd.), and the resulting mixture was then dispersed by applying ultrasonic thereto for one hour. The dispersion was then evaporated slowly in a rotary evaporator to remove the methyl ethyl ketone, whereby forcing the silicone epoxy varnish deposit onto the sensitized zinc oxide powder. To the resultant was added 170 ml. of the non-solvent "Isopar-H", and the mixture was then heated at 150° C. for 3 hours. The solid particles were collected by filtration over a glass filter and dried to prepare a photoconductive material having an encapsulating layer made of a silicone modified epoxy resin.

| | |
|---|---|
| Encapsulated photoconductive material prepared as above | 100 g. |
| 50% Solution of acrylic resin "Dianal HR-116" (available from Mitsubishi Rayon Co., Ltd.) | 40 g. |
| 50% Solution of butyrated melamine resin "Super-Beckamine J-820" (available from Dainippon Ink and Chemicals, Inc.) | 8 g. |
| Silicone oil "KF 96" (available from Shin-Etsu Chemical Co., Ltd.) | 0.5 g. |
| Toluene | 100 ml. |

The mixture of the above formulation was dispersed for one hour by means of a ball mill to prepare a coating solution for the photosensitive layer formation.

The coating solution thus obtained was coated on the intermediate layer laid on the electroconductive support to prepare a film of the thickness of 30 g./m$^2$ (after being dried), and dried by applying the blowing air kept at 70° C. thereto. The resulting element was further heated for one hour in an oven kept at 100° C. to prepare an electrophotographic photosensitive element.

The photosensitive element was then subjected to a continuous copying test by loading the element on a conveyor belt for a photosensitive element in an electrophotographic copying machine "U-Bix 1500" (available from Konishiroku Photo Ind. Co., Ltd.). A high gradation reproducibility giving a high contrast copied image was still produced even after the copying procedure was continuously repeated 10,000 times.

Comparison between the first and second copied images showed no distinguishable difference on the image contrast, and thus there was confirmed substantially no memory effect appearing in this system.

An electrophotographic photosensitive element was prepared, for comparison, by employing the same procedures as stated above, except for replacing the encapsulated zinc oxide particles with simple zinc oxide particles with no coating layer. The copying test carried out above was repeated using the electrophotographic photosensitive element thus prepared. When the number of the repeated copying procedures reached around 10,000 times, an obtained copied image began to show reduced image contrast and the fog began to be seen on the image to render the image obscure. Comparison between the first and second copied images showed that the second image was worse than the first image. Also, the memory effect was found to appear.

Another electrophotographic photosensitive element was prepared, also for comparison, by employing the same procedures as stated above, except for replacing the polyethylene used as the resinous backing layer with a polypropylene resin. The copying test as above was repeated using, in parallel, the element prepared initially in this Example and the element thus prepared, in the same electrophotographic copying machine "U-Bix 1500". The former element worked with no trouble to give 5,000 copies. The latter element was electrostatically adsorbed by the master supporting mechanism to disturb the operation, when the number of the repeated copying procedures reached approximately 2,000 times.

EXAMPLE 5

To 100 g. of Argentine casein was added 400 ml. of water, and this mixture was heated to 40° C. for 4 hours to make the casein well. To this was further added 10 ml. of concentrated aqueous ammonia, and the mixture was stirred. Then, a mixture of water and methanol (8:2) was added to the resulting mixture to make the total volume to one liter. The coating solution for the intermediate layer formation thus obtained was coated on the electroconductive support in the same manner as in Example 4 to prepare an intermediate layer.

Separately, 100 g. of a photoconductive zinc oxide powder "SAZEX 4000" was added to a mixture of 150 ml. of ethyl acetate dissolving 0.5 g. of a free acid form of Rose Bengal therein and 50 ml. of a non-solvent "Isopar-H", and the resulting mixture was further treated in a ball mill for one hour to make a dispersion. To the dispersion were added 1.0 g. of a silicone polyol "KR 302A" (available from Shin-Etsu Chemical Co., Ltd.) and 0.5 g. of a poly(isocyanate) "KR 302B" (available from Shin-Etsu Chemical Co., Ltd.), and the mixture was again treated in a ball mill for one hour. The ethyl acetate was evaporated in a rotary evaporator, and 150 ml. of a non-solvent "Isopar-H" was added to the residue. The mixture was heated to 130° C. for one hour, and the solid particles were collected by filtration and dried. Thus, a photoconductive material encapsulated with the silicone-modified urethane resin was prepared.

| | |
|---|---|
| Encapsulated photoconductive material prepared as above | 100 g. |
| 70% Solution of silicone resin "KR 214" (available from Shin-Etsu Chemical Co., Ltd.) | 15 g. |
| 50% Solution of acrylic resin "ST-10" (available from Soken Chemical Co., Ltd.) | 20 g. |
| 7.5% Solution of ethyl cellulose "STD-45" (available from Dow Chemical Co., Ltd.) | 60 g. |
| Toluene | 100 ml. |

The mixture of the above formulation was dispersed for one hour by means of a ball mill to prepare a coating solution for the photosensitive layer formation. The coating solution thus obtained was coated on the intermediate layer on the aforementioned electroconductive support to form a photosensitive layer in the same manner as in Example 1. Thus, there was prepared an electrophotographic photosensitive element.

The photosensitive element was subjected to a continuous copying test by providing it to an electrophotographic copying machine "U-Bix 1500" (available from Konishiroku Photo Ind. Co., Ltd.). A high gradation reproducibility giving a high contrast copied image was still produced even after the copying procedure was continuously repeated 10,000 times. Also, there was confirmed substantially no memory effect appearing in this system.

What is claimed is:

1. A photosensitive element for electrophotography which comprises (a) a photosensitive layer comprising
  (1) a binder resin and (2) photoconductive zinc oxide particles being dispersed in said binder resin, said photoconductive zinc oxide particles having been encapsulated over its surface with an encapsulating resinous layer;

(b) an electroconductive support for said photosensitive layer; and (c) an intermediate layer consisting essentially of a water-soluble polymer and said intermediate layer being located between said photosensitive layer and said support.

2. A photosensitive element according to claim 1, wherein said water-soluble polymer is a casein.

3. A photosensitive element according to claim 2, wherein said casein having been treated with ammonia.

4. A photosensitive element according to claim 1, wherein a sensitizing agent for said zinc oxide having been enclosed by said encapsulating resinous layer.

5. A photosensitive element according to claim 1, wherein said electroconductive support carries, on the other surface, a resinous layer, at least 60% of said resin being polyethylene.

6. A photosensitive element for electrophotography which comprises:

(a) a photosensitive layer positioned on one side of a support comprising (1) a binder resin and (2) resin encapsulated photoconductive particles, comprising zinc oxide together with a sensitizing agent encapsulated within a resinous surface layer, dispersed in said binder resin;

(b) an electroconductive support for said photosensitive layer, carrying, on the other side, a resinous layer, at least 60% of said resin being polyethylene; and (c) an intermediate layer consisting essentially of casein having been treated with ammonia and said intermediate layer being located between said photosensitive layer and said support.

* * * * *